US009543629B2

(12) United States Patent
Tong

(10) Patent No.: US 9,543,629 B2
(45) Date of Patent: Jan. 10, 2017

(54) CAVITY FILTER, CONNECTOR AND MANUFACTURING PROCESSES THEREOF

(71) Applicant: SHENZHEN TATFOOK TECHNOLOGY CO., LTD., Shenzhen, Guangdong Province (CN)

(72) Inventor: Endong Tong, Shenzhen (CN)

(73) Assignee: SHENZHEN TATFOOK TECHNOLOGY CO., LTD., Shenzhen, Guangdong Province (CN)

( * ) Notice: Subject to any disclaimer, the term of this patent is extended or adjusted under 35 U.S.C. 154(b) by 2 days.

(21) Appl. No.: 14/383,984

(22) PCT Filed: Mar. 8, 2013

(86) PCT No.: PCT/CN2013/072329

§ 371 (c)(1),
(2) Date: Sep. 9, 2014

(87) PCT Pub. No.: WO2013/131488

PCT Pub. Date: Sep. 12, 2013

(65) Prior Publication Data

US 2015/0061794 A1 Mar. 5, 2015

(30) Foreign Application Priority Data

Mar. 9, 2012 (CN) ..... 2012 1 0061804

(51) Int. Cl.
*H01P 5/00* (2006.01)
*H01R 13/52* (2006.01)
(Continued)

(52) U.S. Cl.
CPC ..... *H01P 5/00* (2013.01); *H01P 1/207* (2013.01); *H01P 7/06* (2013.01); *H01P 11/00* (2013.01);
(Continued)

(58) Field of Classification Search
USPC ... 439/578, 188, 675, 263; 333/202, 260, 33
See application file for complete search history.

(56) References Cited

U.S. PATENT DOCUMENTS 4,360,245 A * 11/1982 Nikitas ..... 439/578
5,796,315 A * 8/1998 Gordon et al. ..... 333/24 C
(Continued)

FOREIGN PATENT DOCUMENTS

CN 201038287 Y 3/2008
CN 201252293 Y 6/2009
(Continued)

*Primary Examiner* — Alexander Gilman
(74) *Attorney, Agent, or Firm* — Cheng-Ju Chiang

(57) ABSTRACT

The present disclosure relates to a cavity filter, a connector and manufacturing processes thereof. The cavity filter comprises a cavity, a cover plate and a connector disposed on the cavity or the cover plate; an end of the connector is connected with internal devices inside the cavity filter and the other end of the connector is connected with external communication devices; and the connector comprises an inner conductor and a metal enclosure disposed coaxially and an insulation medium disposed between the metal enclosure and the inner conductor, and a non-metal layer is disposed on an outer peripheral surface of the metal enclosure. The connector of the present disclosure is formed with a non-metal layer on the outer peripheral surface of the metal enclosure thereof, which can improve the moisture-proof capability, the salt-mist-proof capability, the mold-proof capability and the reliability of the connector and the cavity filter.

4 Claims, 10 Drawing Sheets

(51) Int. Cl.

| | |
|---|---|
| ***H01P 7/06*** | (2006.01) |
| ***H01P 1/207*** | (2006.01) |
| ***H01P 11/00*** | (2006.01) |
| *H01R 24/40* | (2011.01) |

(52) U.S. Cl.
CPC ..... *H01R 13/5219* (2013.01); *H01R 24/40* (2013.01); *Y10T 29/4922* (2015.01)

(56) References Cited

U.S. PATENT DOCUMENTS

| | | | | |
|---|---|---|---|---|
| 5,836,776 | A * | 11/1998 | Koch | 439/188 |
| 5,904,587 | A * | 5/1999 | Osypka et al. | 439/263 |
| 5,980,326 | A * | 11/1999 | Weidner et al. | 439/675 |
| 6,580,341 | B2 * | 6/2003 | Henningsson et al. | 333/202 |
| 6,778,044 | B2 * | 8/2004 | Fehrenbach et al. | 333/260 |
| 6,780,051 | B2 * | 8/2004 | Otsu | 439/578 |
| 6,850,129 | B2 * | 2/2005 | Lagerstedt | 333/33 |
| 7,435,096 | B2 | 10/2008 | Wang et al. | |
| 7,727,014 | B2 * | 6/2010 | Zhu et al. | 439/578 |
| 7,841,899 | B2 * | 11/2010 | Taskila et al. | 439/581 |
| 7,871,295 | B2 * | 1/2011 | Zhang et al. | 439/578 |
| 8,154,363 | B2 * | 4/2012 | Kaegebein | 333/207 |
| 8,622,768 | B2 * | 1/2014 | Van Swearingen et al. | 439/578 |
| 9,048,527 | B2 * | 6/2015 | Vaccaro et al. | |
| 2005/0277331 | A1 | 12/2005 | Hall | |
| 2009/0280682 | A1 * | 11/2009 | Zhang et al. | 439/578 |
| 2010/0022123 | A1 | 1/2010 | Zhang et al. | |
| 2011/0003507 | A1 * | 1/2011 | Van Swearingen et al. | 439/578 |
| 2011/0256759 | A1 * | 10/2011 | Kunes et al. | 439/578 |
| 2012/0244748 | A1 * | 9/2012 | Purdy | 439/578 |
| 2013/0244483 | A1 * | 9/2013 | Montena | 439/578 |
| 2015/0061794 | A1 | 3/2015 | Tong | |

FOREIGN PATENT DOCUMENTS

| | | | |
|---|---|---|---|
| CN | 101908664 | A | 12/2010 |
| CN | 202121038 | U | 1/2012 |
| CN | 102623829 | A | 8/2012 |
| CN | 202495600 | U | 10/2012 |
| GB | 2267398 | A | 12/1993 |

* cited by examiner

CAVITY FILTER, CONNECTOR AND MANUFACTURING PROCESSES THEREOF

CROSS REFERENCE TO RELATED APPLICATIONS

The present application is a 35 U.S.C. §371 National Phase conversion of International (PCT) Patent Application No. PCT/CN2013/072329, filed on Mar. 8, 2013, the disclosure of which is incorporated by reference herein. The PCT International Patent Application was filed and published in Chinese.

FIELD OF THE INVENTION

The present disclosure relates to the technical field of communications, and more particularly, to a cavity filter, a connector and manufacturing processes thereof.

BACKGROUND OF THE INVENTION

As important components of communication modules, filters or duplexers are usually provided with connectors (e.g., 7/16 connectors, N-type connectors, etc.) for connection with other modules. The connectors are usually connected with the filters or duplexers by means of screws. In order to satisfy the radio frequency (RF) specifications and to match the conventional manufacturing processes (e.g., machining, die casting and electroplating), the connectors are all made of brass or aluminum alloys, and then an electroplated protection film such as a silver layer, a copper layer or a ternary alloy layer is electroplated on a surface thereof. For some special applications such as outdoor environments, seaside environments or very humid environments, a layer of powders is sprayed onto the surfaces of the connectors to prolong the service life and to prevent premature failure of the connectors. However, this layer of powders is difficult to control and tends to fall off.

Meanwhile, enclosures of the connectors are all fabricated through machining, die casting, or die casting plus machining. If the enclosures are fabricated through machining, the complex features (e.g., screws) of the enclosures of the connectors will lead to a long production time, low efficiency and a high production cost. If the enclosures are fabricated through a die casting process, the resulting connectors will become unaesthetic and the "three-proofing" capabilities of the connectors will be degraded because of the coarse surface of the die-cast enclosures. If the enclosures are fabricated through a die casting plus machining process, then the process route will become long and complex to cause a high production cost.

Accordingly, the conventional cavity filters and connectors thereof still present inconveniences and have shortcomings in practical use, so a need exists in the art to make an improvement on them.

SUMMARY OF THE INVENTION

In view of this, a cavity filter, a connector and manufacturing processes thereof are provided in the present disclosure, which can simplify the production process, improve the "three-proofing" capabilities and reliability of the whole product, and reduce the labor intensity and the production cost.

To achieve the aforesaid objectives, the present disclosure provides a connector for a cavity filter, comprising an inner conductor and a metal enclosure disposed coaxially and an insulation medium disposed between the metal enclosure and the inner conductor, wherein a non-metal layer is disposed to cover an outer peripheral surface of the metal enclosure, the metal enclosure comprises a cylindrical portion and a flange portion located at an end of the cylindrical portion, and the flange portion comprises an end surface that connects with the cylindrical portion and an end surface that is away from the cylindrical portion.

In the connector of the present disclosure, the outer peripheral surface of the metal enclosure is provided with a restricting structure for preventing falling off of the non-metal layer, and the metal enclosure is closely joined with the non-metal layer by means of the restricting structure.

In the connector of the present disclosure, the connector is connected to the cavity filter, the flange portion of the metal enclosure is located on an outer surface of a cavity of the cavity filter, and the end surface of the flange portion that is away from the cylindrical portion makes contact with the outer surface of the cavity of the cavity filter.

In the connector of the present disclosure, an annular groove surrounding the insulation medium is formed on the end surface of the flange portion that makes contact with the outer surface of the cavity of the cavity filter, and a seal ring is disposed within the annular groove.

In the connector of the present disclosure, a diameter of a cross section of the seal ring is greater than a depth of the annular groove when the connector is not installed on the cavity filter; and the seal ring is compressed and restricted inside the annular groove when the connector is installed on the cavity filter.

In the connector of the present disclosure, the non-metal layer covers an outer peripheral surface of the cylindrical portion of the connector, the end surface of the flange portion that connects with the cylindrical portion, an interior of the annular groove, and an area from the annular groove to an outer edge of the flange portion.

In the connector of the present disclosure, the connector is connected to the cavity filter, the flange portion of the metal enclosure is located on an inner surface of the cavity of the cavity filter, and the end surface of the flange portion that connects with the cylindrical portion makes contact with the inner surface of the cavity of the cavity filter.

In the connector of the present disclosure, an annular groove is formed on the end surface of the flange portion that makes contact with the inner surface of the cavity of the cavity filter, and a seal ring is disposed within the annular groove.

In the connector of the present disclosure, a diameter of a cross section of the seal ring is greater than a depth of the annular groove when the connector is not installed on the cavity filter; and the seal ring is compressed and restricted inside the annular groove when the connector is installed on the cavity filter.

The present disclosure further provides a cavity filter, comprising a cavity, a cover plate and a connector disposed on the cavity or the cover plate, an end of the connector being connected with internal devices inside the cavity filter and the other end of the connector being connected with external communication devices, wherein the connector comprises an inner conductor and a metal enclosure disposed coaxially and an insulation medium disposed between the metal enclosure and the inner conductor, and a non-metal layer is disposed to cover an outer peripheral surface of the metal enclosure, the metal enclosure comprises a cylindrical portion and a flange portion located at an end of the cylindrical portion, and the flange portion comprises an end surface that connects with the cylindrical portion and an end surface that is away from the cylindrical portion.

In the cavity filter of the present disclosure, the outer peripheral surface of the metal enclosure is provided with a restricting structure for preventing falling off of the non-metal layer, and the metal enclosure is closely joined with the non-metal layer by means of the restricting structure.

In the cavity filter of the present disclosure, the connector is connected to the cavity filter, the flange portion of the metal enclosure is located on an outer surface of the cavity of the cavity filter, and the end surface of the flange portion that is away from the cylindrical portion makes contact with the outer surface of the cavity of the cavity filter.

In the cavity filter of the present disclosure, an annular groove surrounding the insulation medium is formed on the end surface of the flange portion that makes contact with the outer surface of the cavity of the cavity filter, and a seal ring is disposed within the annular groove.

In the cavity filter of the present disclosure, a diameter of a cross section of the seal ring is greater than a depth of the annular groove when the connector is not installed on the cavity filter; and the seal ring is compressed and restricted inside the annular groove when the connector is installed on the cavity filter.

In the cavity filter of the present disclosure, the non-metal layer covers an outer peripheral surface of the cylindrical portion of the connector, the end surface of the flange portion that connects with the cylindrical portion, an interior of the annular groove, and an area from the annular groove to an outer edge of the flange portion.

In the cavity filter of the present disclosure, the connector is connected to the cavity filter, the flange portion of the metal enclosure is located on an inner surface of the cavity of the cavity filter, and the end surface of the flange portion that connects with the cylindrical portion makes contact with the inner surface of the cavity of the cavity filter.

In the cavity filter of the present disclosure, an annular groove is formed on the end surface of the flange portion that makes contact with the inner surface of the cavity of the cavity filter, and a seal ring is disposed within the annular groove.

In the cavity filter of the present disclosure, a diameter of a cross section of the seal ring is greater than a depth of the annular groove when the connector is not installed on the cavity filter; and the seal ring is compressed and restricted inside the annular groove when the connector is installed on the cavity filter.

In the cavity filter of the present disclosure, the non-metal layer is formed of a plastic material or a macromolecular polymer.

The present disclosure further provides a manufacturing process of a connector, comprising:

forming an inner conductor and a metal enclosure of the connector through machining, die casting, or machining plus die casting, wherein the metal enclosure comprises a cylindrical portion and a flange portion located at an end of the cylindrical portion, and the flange portion comprises an end surface that connects with the cylindrical portion and an end surface that is away from the cylindrical portion;

electroplating the metal enclosure and the inner conductor;

forming a non-metal layer on an outer peripheral surface of the metal enclosure of the connector through injection molding or die casting; and pressing an insulation medium having a size matching the metal enclosure into the metal enclosure and then pressing the inner conductor into the insulation medium.

By disposing the non-metal layer outside the metal enclosure of the connector in the present disclosure, the moisture-proof capability, the salt-mist-proof capability, the mould-proof capability and the reliability of the connector in special environments can be enhanced. In the conventional connector, powders are sprayed to an outer surface of the connector to form a protection layer, but the thickness of the powder sprayed is difficult to control and this leads to a poor protection effect of the connector; and the time needed for powder spraying is relatively long and the process is complex; and moreover, the powder spraying is carried out manually, and the dusts produced cause high pollution to the environment and injury to the operation personnel. In contrast, the connector adopting the structure of the present disclosure can overcome these shortcomings. Specifically, the non-metal layer can be formed outside the metal enclosure through a die casting or injection molding process, which is simple and free of pollution to the environment, requires less human intervention, simplifies the operation procedures in the production of the connector and reduces the labor intensity; and meanwhile, the connector of the present disclosure is made partly of a metal and partly of a non-metal material, and the light weight and low cost of the non-metal material can reduce the weight and the production cost of the connector. Thereby, the present disclosure simplifies the manufacturing process, improves the "three-proofing" capabilities and the reliability of the whole product and, meanwhile, reduces the labor intensity and the production cost.

DETAILED DESCRIPTION OF THE INVENTION

Figure 1:
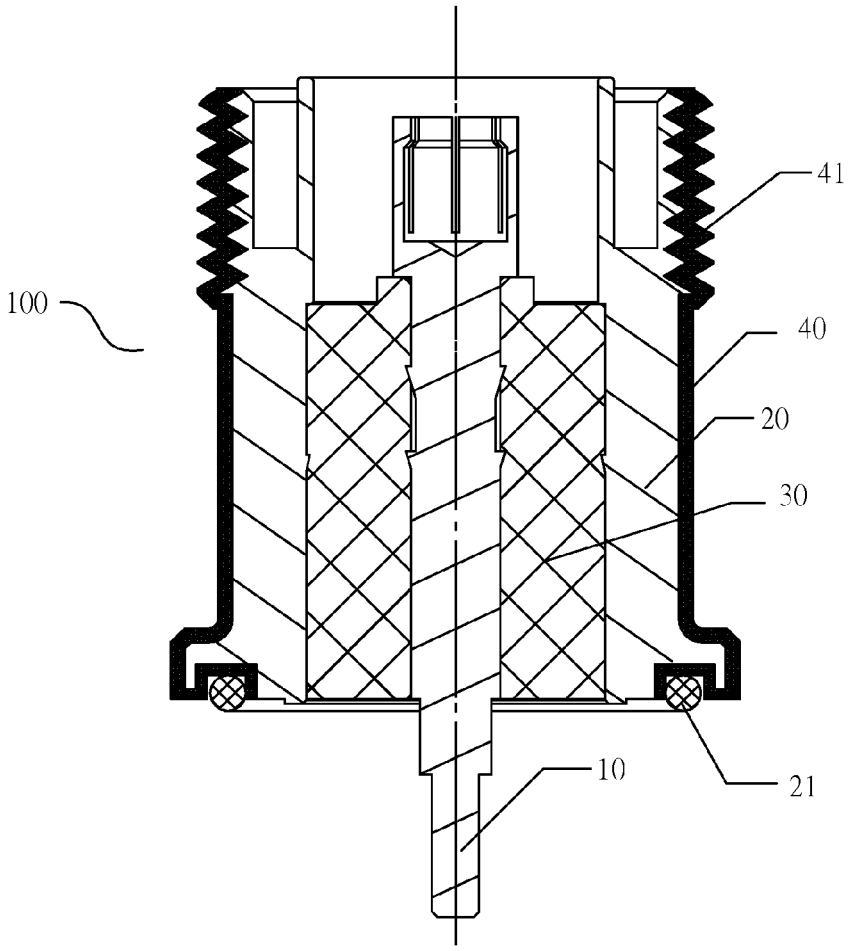
FIG. 1 is a cross-sectional view of a first embodiment of a connector according to the present disclosure.

Hereinbelow, the technical solutions of the embodiments of the present disclosure will be clearly and fully described with reference to the attached drawings in the embodiments of the present disclosure. It shall be understood that, the embodiments described herein are only provided to illustrate rather than to limit the present disclosure.

As shown in FIGS. 1~8, a connector 100 of the present disclosure comprises an inner conductor 10 and a metal enclosure 20 disposed coaxially and an insulation medium 30 disposed between the metal enclosure 20 and the inner conductor 10, where a non-metal layer 40 is disposed to cover an outer peripheral surface of the metal enclosure 20.

By disposing the non-metal layer 40 outside the metal enclosure 20 of the connector 100 in the present disclosure, the moisture-proof capability, the salt-mist-proof capability, the mould-proof capability and the reliability of the connector 100 in special environments can be enhanced. In the conventional connector, powders are sprayed to an outer surface of the connector to form a protection layer, but the thickness of the powder sprayed is difficult to control and this leads to a poor protection effect of the connector; and the time needed for powder spraying is relatively long and the process is complex; and moreover, the powder spraying is carried out manually, and the dusts produced cause high pollution to the environment and injury to the operation personnel. In contrast, the connector adopting the structure of the present disclosure can overcome these shortcomings. Specifically, the non-metal layer 40 can be formed outside the metal enclosure 20 through a die casting or injection molding process, which is simple and free of pollution to the environment, requires less human intervention, simplifies the operation procedures in the production of the connector and reduces the labor intensity; and meanwhile, the connector 100 of the present disclosure is made partly of a metal and partly of a non-metal material, and the light weight and low cost of the non-metal material can reduce the weight and the production cost of the connector 100. Thereby, the present disclosure simplifies the manufacturing process, improves the "three-proofing" capabilities and the reliability of the whole product and, meanwhile, reduces the labor intensity and the production cost.

Preferably, the outer peripheral surface of the metal enclosure 20 is provided with a restricting structure for preventing falling off of the non-metal layer 40; the metal enclosure 20 is closely joined with the non-metal layer 40 by means of the restricting structure; and the restricting structure is a mesh-like or sawteeth-like groove and may also be a knurled restricting structure or a restricting structure of other forms so that a greater binding force is achieved between the non-metal layer 40 and the metal enclosure 20.

The connector 100 of the present disclosure further comprises a screw portion 41 disposed on an outer surface of the non-metal layer 40. An end of the connector 100 is adapted to connect with a filter or a duplexer, and the other end thereof is adapted to connect with other communication modules. The end of the connector 100 that connects with the filter or the duplexer is provided with a seal ring 21, and the other end of the connector 100 connects with the communication modules by means of the screw portion 41. The screw portion 41 is also formed on the non-metal layer 40 having the "three-proofing" capabilities so that the two ends of the connector 100 that connect with the filter or the duplexer and other communication modules respectively are both sealed effectively to further enhance the moisture-proof capability, the salt-mist-proof capability, the mould-proof capability and the reliability of the connector 100. There are two ways to form the screw portion 41: the first way is to firstly form screws on the outer surface of the metal enclosure 20 and then form the non-metal screw portion 41 on the basis of the screws already formed, as shown in FIG. 1, FIG. 3 and FIG. 6; and the other way is to directly form the non-metal screw portion 41 on the metal enclosure 20 through injection molding or die casting and no screws are formed on the outer surface of the metal enclosure 20, as shown in FIG. 2, FIG. 4, and FIG. 8.

Preferably, the non-metal layer 40 is a plastic layer, which may be formed through injection molding or die casting. Obviously, the non-metal layer 40 may also be formed of a macromolecular polymer such as rubber, plastic, etc. The injection molding process is used instead of the conventional powder spraying process to form a protection layer on the outer surface of the connector 100, and the product formed through the injection-molding process is aesthetic and has a low cost. This can simplify the manufacturing process and reduce the production cost as compared to the conventional connectors formed through machining, die casting, or machining plus die casting.

Figure 2:
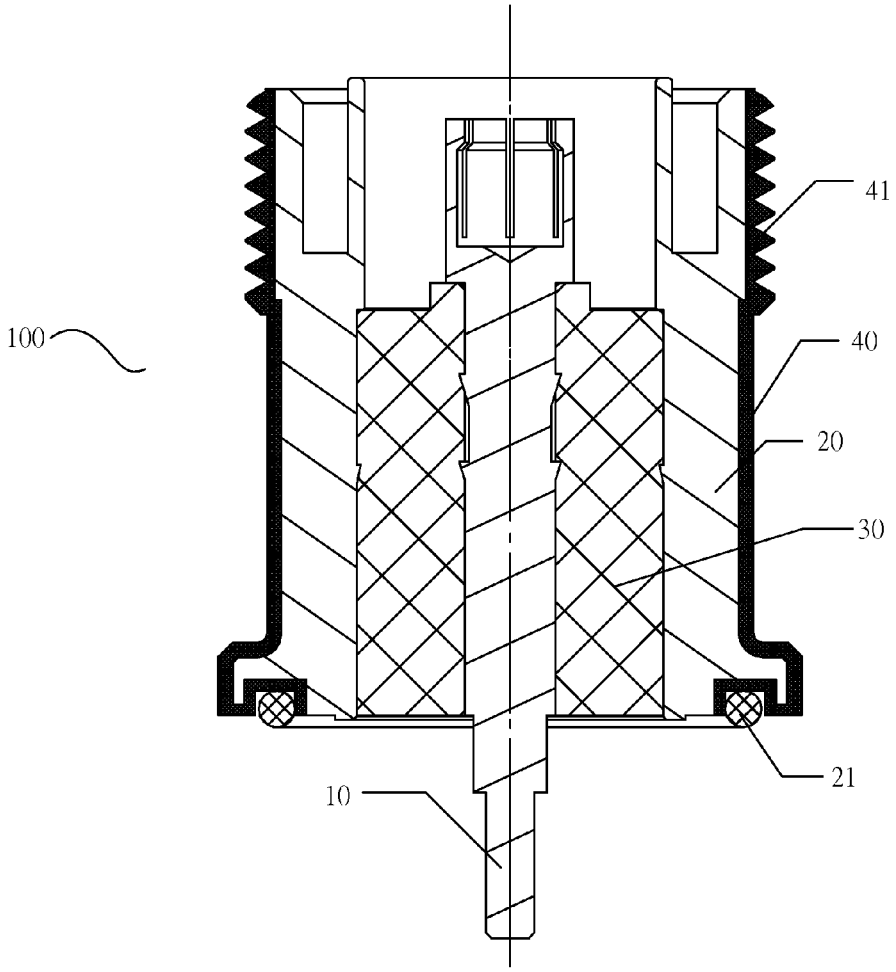
FIG. 2 is a cross-sectional view of a second embodiment of the connector according to the present disclosure.
Figure 3:
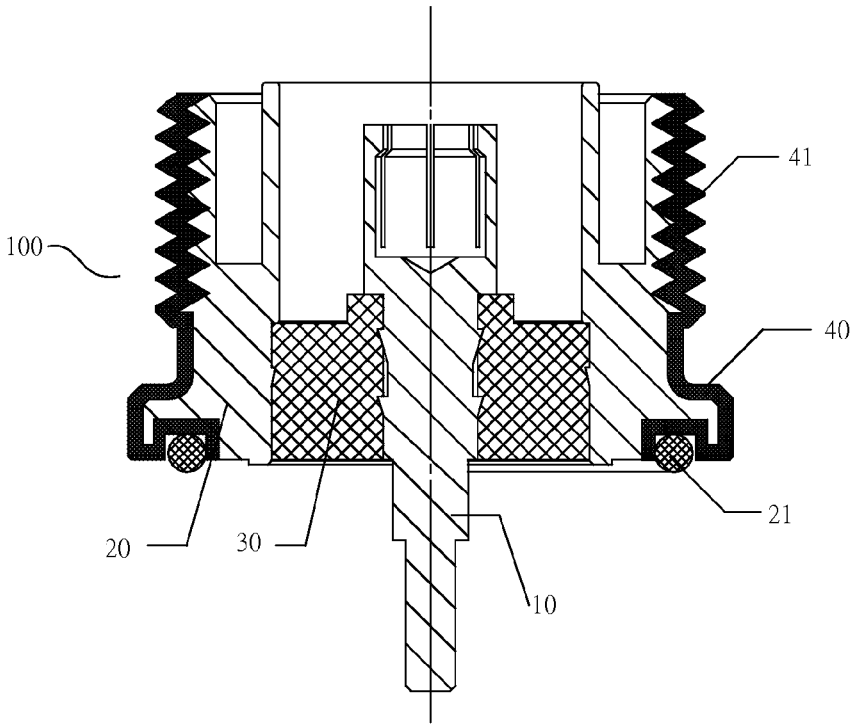
FIG. 3 is a cross-sectional view of a third embodiment of the connector according to the present disclosure.
Figure 4:
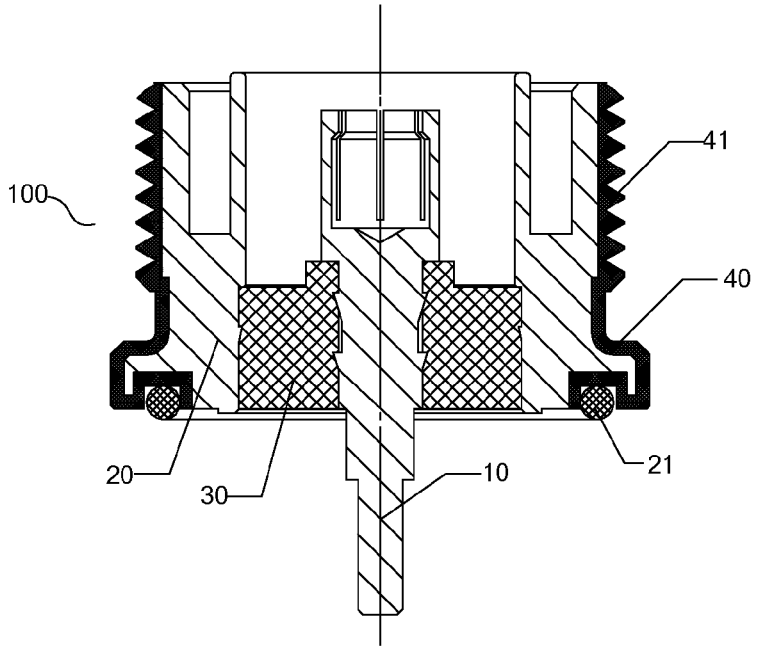
FIG. 4 is a cross-sectional view of a fourth embodiment of the connector according to the present disclosure.
Figure 6:
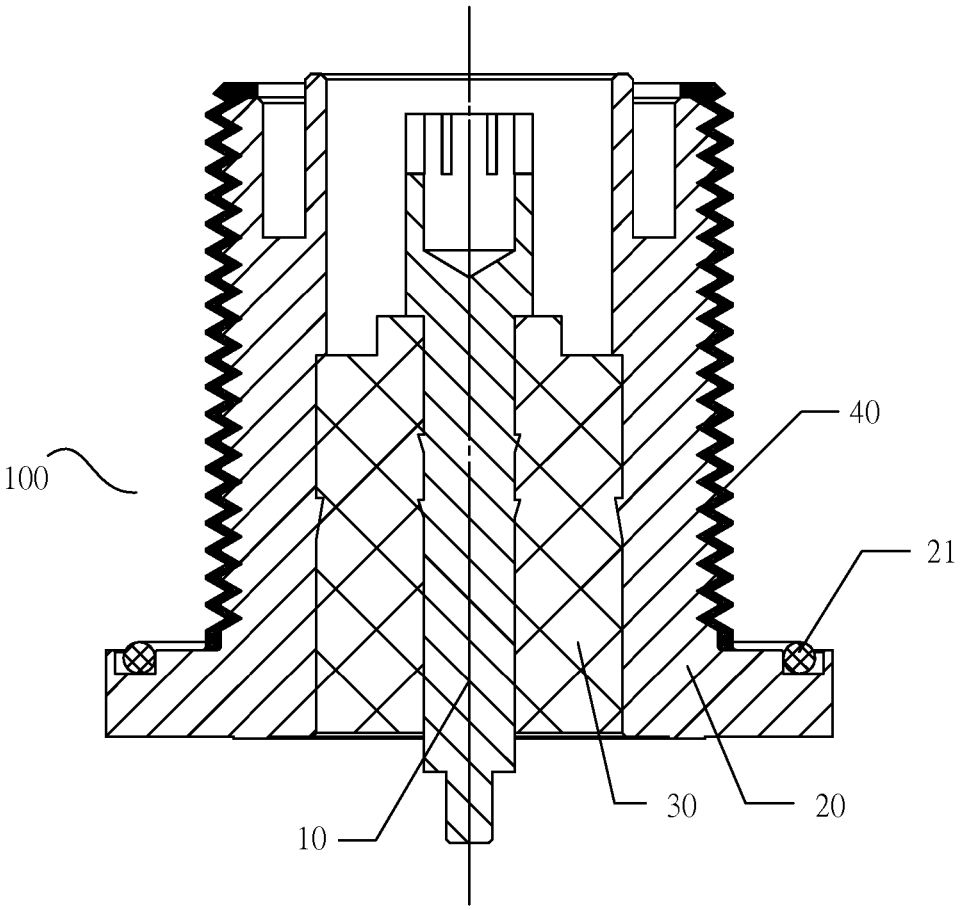
FIG. 6 is a cross-sectional view of a fifth embodiment of the connector according to the present disclosure.
Figure 8:
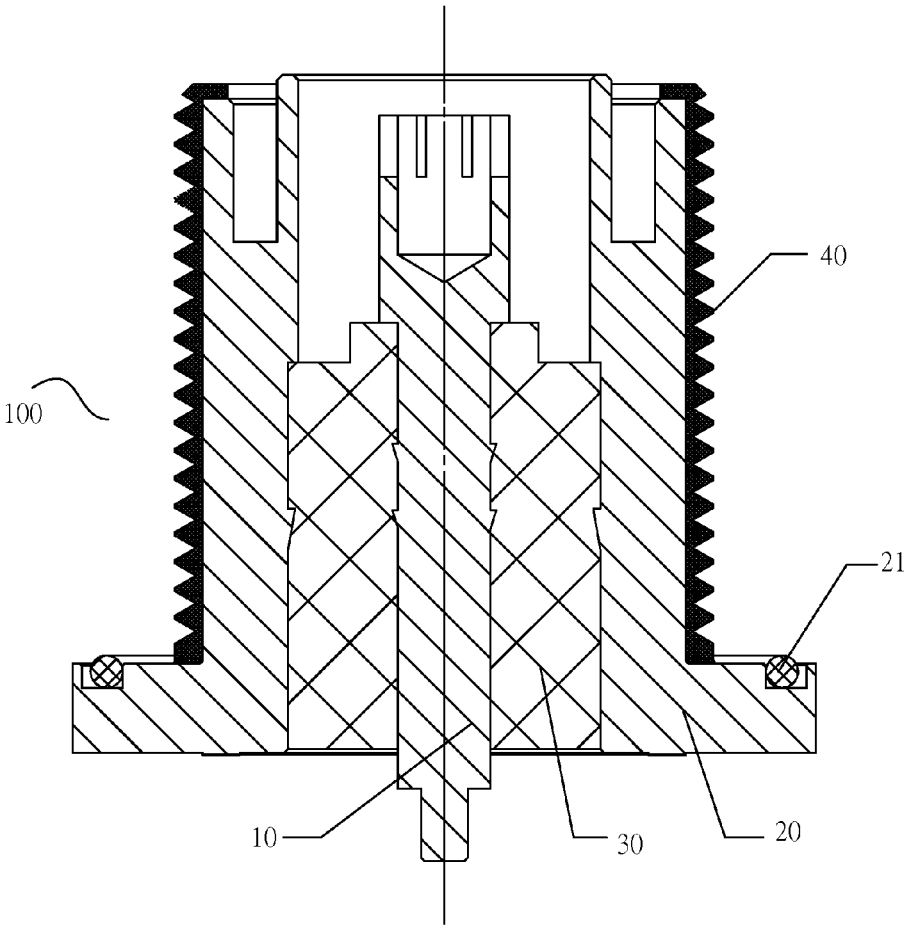
FIG. 8 is a cross-sectional view of a sixth embodiment of the connector according to the present disclosure.

In the embodiments shown in FIG. 1, FIG. 3, and FIG. 6, the outer peripheral surface of the metal enclosure 20 are formed with screws, and the screw portion 41 of the connector 100 is further formed on the basis of the outer screws of the metal enclosure 20 already formed; and in the embodiments shown in FIG. 2, FIG. 4 and FIG. 8, the outer peripheral surface of the metal enclosure 20 is not formed with screws, and the screw portion 41 is formed on the outer peripheral surface of the metal enclosure 20 directly through injection molding or die casting.

Figure 5:
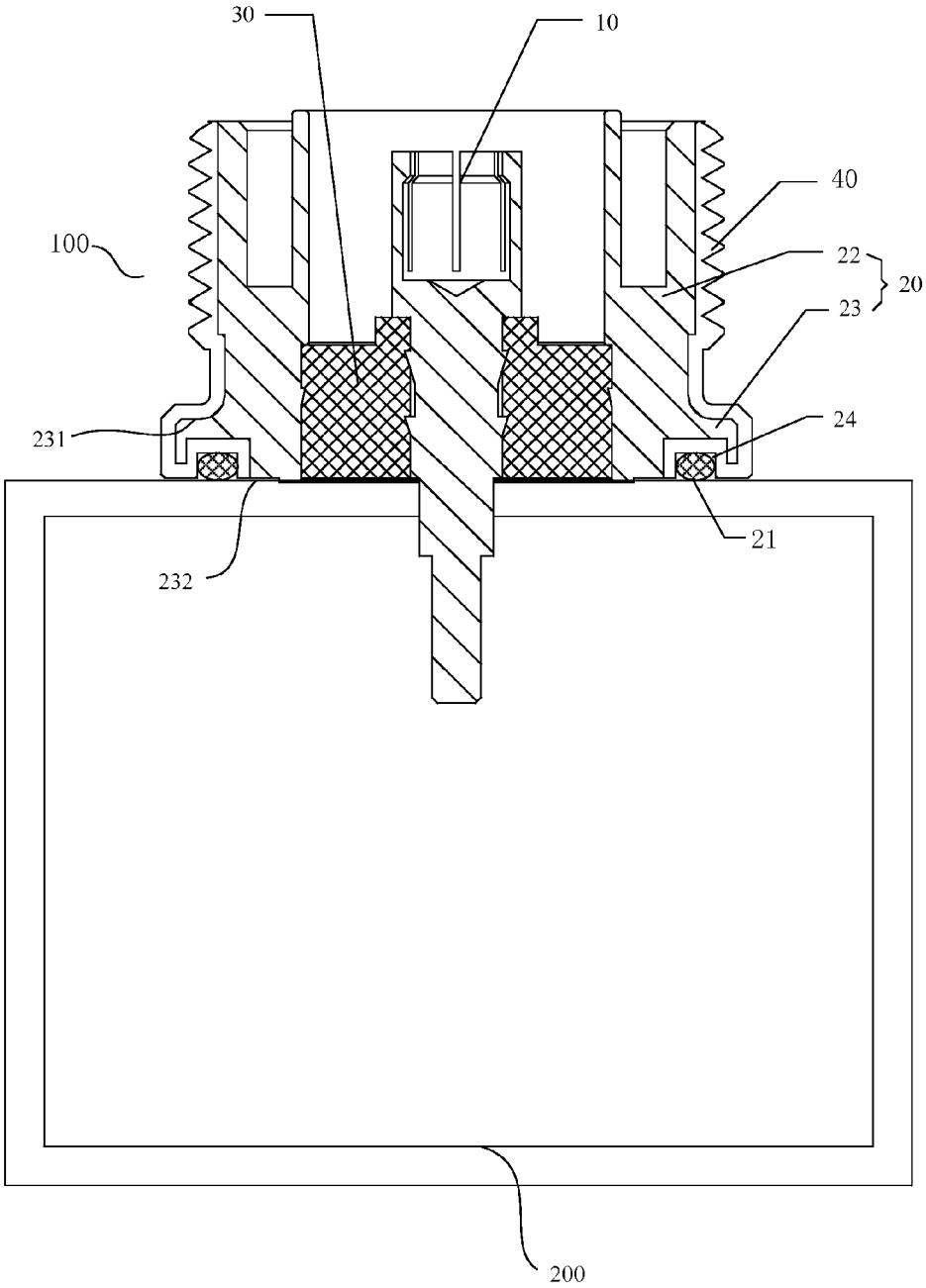
FIG. 5 is a schematic view illustrating how the connector in FIG. 4 is connected with a cavity filter.
Figure 7:
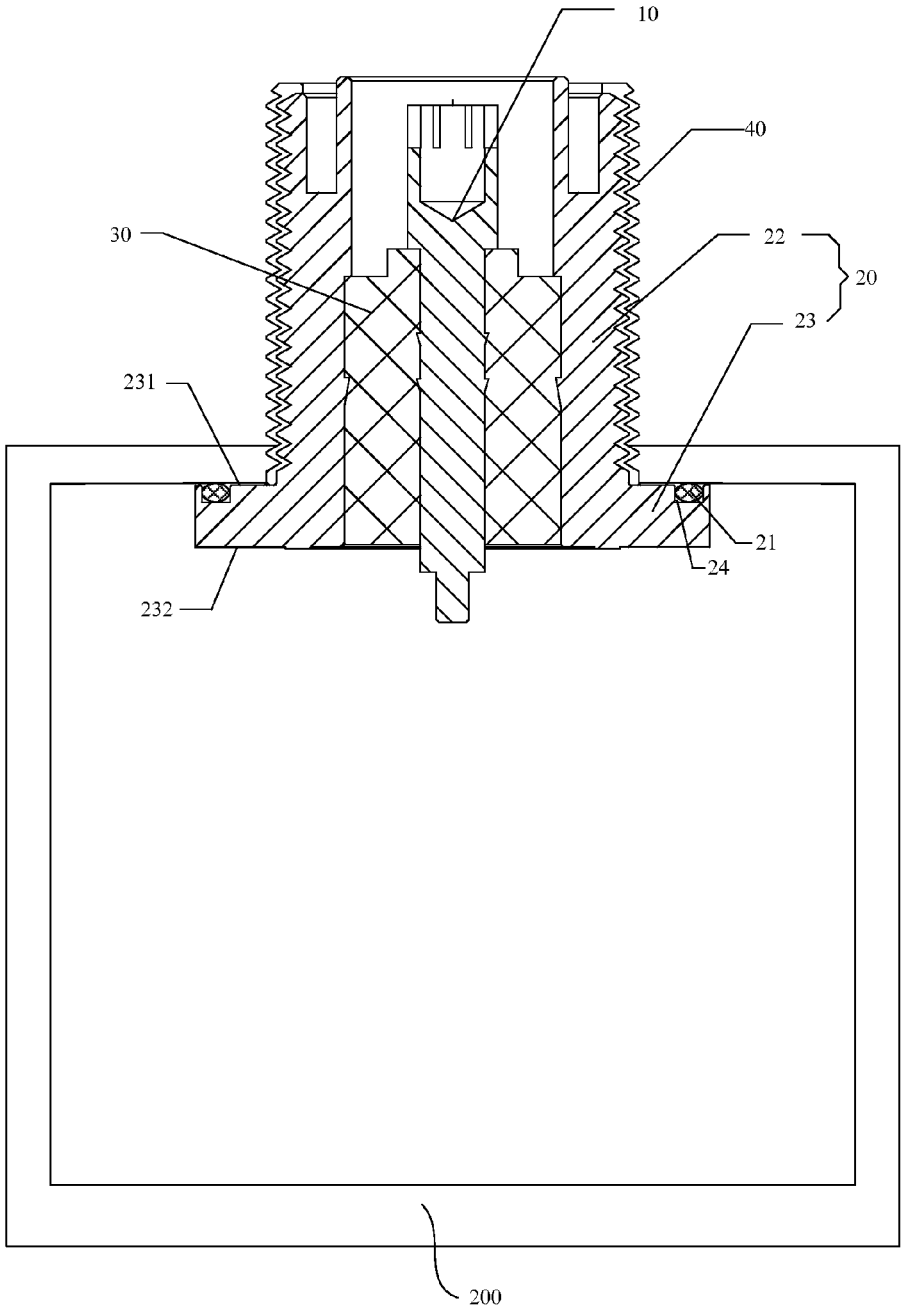
FIG. 7 is a schematic view illustrating how the connector in FIG. 6 is connected with a cavity filter.

FIG. 5 is a schematic view illustrating how the connector 100 in the embodiment shown in FIG. 4 is connected to a cavity filter 200. The connection structure and the connection manner of the connector 100 with the cavity filter 200 shown in FIG. 5 is also applicable to the connector 100 in the embodiments shown in FIGS. 1~3. FIG. 7 is a schematic view illustrating how the connector 100 in the embodiment shown in FIG. 6 is connected to the cavity filter 200, and the connection structure and connection manner of the connector 100 with the cavity filter 200 shown in FIG. 7 is also applicable to the connector 100 in the embodiment shown in FIG. 8. In FIG. 5 and FIG. 7, the connector 100 is connected to the cavity filter 200, the metal enclosure 20 of the connector 100 comprises a cylindrical portion 22 and a flange portion 23 located at an end of the cylindrical portion 22, and the flange portion 23 comprises an end surface 231 that connects with the cylindrical portion 22 and an end surface 232 that is away from the cylindrical portion 22.

In the embodiment shown in FIG. 5, the flange portion 23 of the metal enclosure 20 is located on an outer surface of a cavity of the cavity filter 200, the end surface 232 of the flange portion 23 that is away from the cylindrical portion 22 makes contact with the outer surface of the cavity of the cavity filter 200, an annular groove 24 surrounding the insulation medium 30 of the connector is formed on the end surface 232 of the flange portion 23 that makes contact with the outer surface of the cavity of the cavity filter 200, and a seal ring 21 is disposed within the annular groove 24. A diameter of a cross section of the seal ring 21 is greater than a depth of the annular groove 24 when the connector 100 is not installed on the cavity filter 200; and the seal ring 21 is compressed and restricted inside the annular groove 24 when the connector 100 is installed on the cavity filter 200. The non-metal layer 40 covers an outer peripheral surface of the cylindrical portion of the connector 100, the end surface 231 of the flange portion 23 that connects with the cylindrical portion 22, an interior of the annular groove 24, and an area from the annular groove 24 to an outer edge of the flange portion 23. Thereby, the moisture-proof capability, the salt-mist-proof capability, and the mould-proof capability of the connector 100 and the cavity filter 200 can be enhanced. In the embodiment shown in FIG. 5, the seal ring 21 would directly make contact with the metal enclosure 20 if only the seal ring were provided with the non-metal layer 40 being disposed to cover the interior of the annular groove 24. In that case, moisture and dusts can still enter into the cavity filter 200 through sites where the seal ring makes contact with the metal enclosure. Because the non-metal layer covers the interior of the annular groove 24, the annular groove 24 can restrict the non-metal layer 40 to prevent falling-off of the non-metal layer 40.

In the embodiment shown in FIG. 7, the flange portion 23 of the metal enclosure 20 is located on an inner surface of the cavity of the cavity filter 200, the end surface 231 of the flange portion 23 that connects with the cylindrical portion 22 makes contact with the inner surface of the cavity of the cavity filter 200, an annular groove 24 is formed on the end surface 231 of the flange portion 23 that makes contact with the inner surface of the cavity of the cavity filter 200, and the seal ring 21 is disposed within the annular groove 24. A diameter of a cross section of the seal ring 21 is greater than a depth of the annular groove 24 when the connector 100 is not installed on the cavity filter 200; and the seal ring 21 is compressed and restricted inside the annular groove 24 when the connector 100 is installed on the cavity filter 200. In the embodiments shown in FIGS. 6~8, the non-metal layer 40 only covers the outer peripheral surface of the cylindrical portion of the connector 100. Obviously, in other embodiments, the non-metal layer 40 may further cover the end surface 231 and the interior of the annular groove 24. Thereby, the moisture-proof capability, the salt-mist-proof capability, and the mould-proof capability of the connector 100 and the cavity filter 200 can be enhanced.

Furthermore, the installation position of the seal ring 21 in the embodiments shown in FIGS. 1~4 is different from that in FIG. 6 and FIG. 8. In FIGS. 1~4, the seal ring 21 is located at a side of the metal enclosure 20 that makes contact with the filter or the duplexer, and is not exposed to the outside. In FIG. 6 and FIG. 8, the seal ring 21 is exposed to the outside of the metal enclosure 20. Accordingly, the covering range of the non-metal layer 40 may also vary, and different covering ranges of the non-metal layer may be selected according to different structures of the connectors to achieve the moisture-proof capability, the salt-mist-proof capability, and the mould-proof capability of the connector 100. In FIG. 6 and FIG. 8, the screw portion of the connector 100 is distributed throughout the non-metal layer 40, so it is not depicted.

The present disclosure further provides a cavity filter, which comprises a cavity, a cover plate and a connector disposed on the cavity or the cover plate. An end of the connector is connected with internal devices inside the filter and the other end of the connector is connected with external communication devices. The connector comprises an inner conductor and a metal enclosure disposed coaxially and an insulation medium disposed between the metal enclosure and the inner conductor, and a non-metal layer is disposed to cover an outer peripheral surface of the metal enclosure. The outer peripheral surface of the metal enclosure is provided with a restricting structure for preventing falling off of the non-metal layer, and the metal enclosure is closely joined with the non-metal layer by means of the restricting structure. The restricting structure is a mesh-like or saw-teeth-like groove. The connector further comprises a screw portion disposed on an outer surface of the non-metal layer. The non-metal layer is formed of a plastic material or a macromolecular polymer.

In the conventional connectors, a powder spraying process is used to form a protection layer, but the thickness of the powder sprayed manually is difficult to control. In contrast, the cavity filter provided in the present disclosure forms a non-metal layer outside the metal enclosure of the connector thereof through the die casting or the injection molding process, which simplifies the manufacturing process; and the non-metal layer additionally disposed on the outer peripheral surface of the metal enclosure can enhance the moisture-proof capability, the salt-mist-proof capability, the mould-proof capability and the reliability of the cavity filter. Furthermore, the connector of the present disclosure is not made entirely of the metal material, which can further reduce the weight and the cost of the cavity filter. The structure of the connector of the cavity filter and the manner in which the cavity filter connects with the connector are shown in the embodiments shown in FIGS. 1~8.

Figure 9:
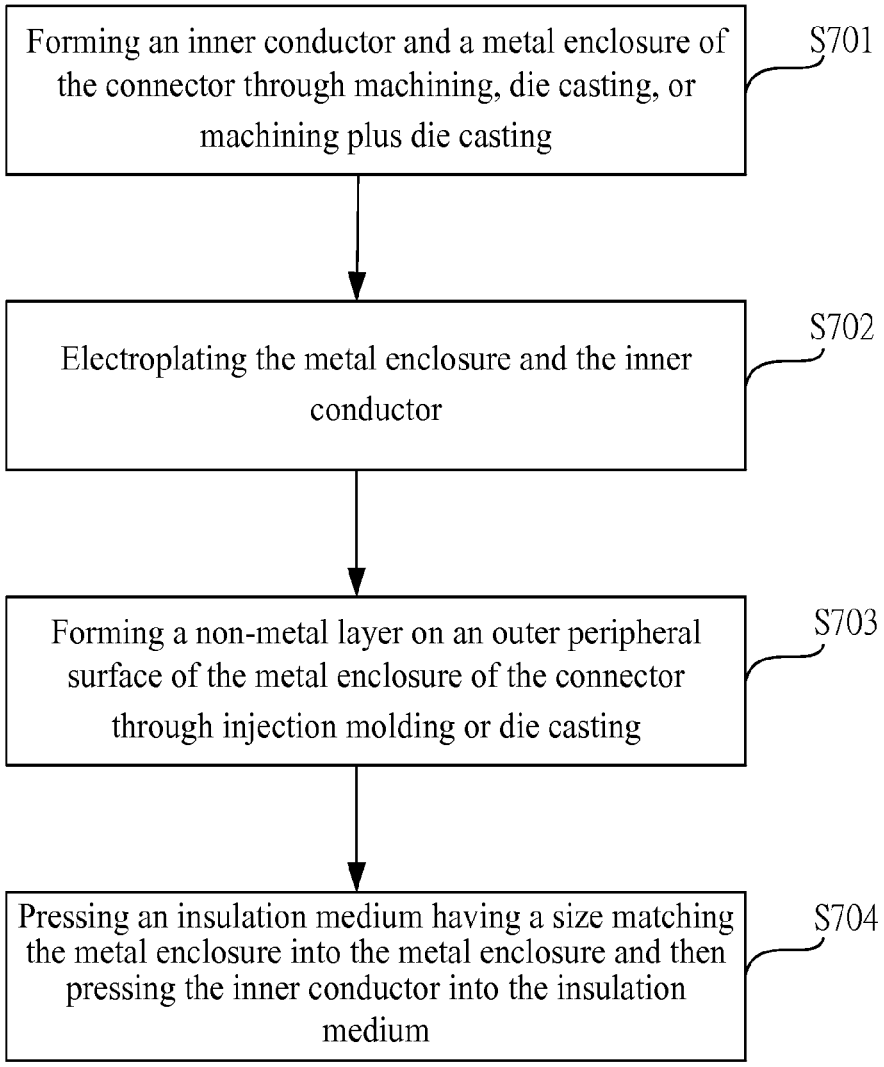
FIG. 9 is a flowchart diagram of a manufacturing process of a connector according to the present disclosure.

As shown in FIG. 9, the present disclosure further provides a manufacturing process of a connector, which mainly comprises the following steps of:

Step S701: forming an inner conductor and a metal enclosure of the connector through machining, die casting, or machining plus die casting. The connector usually comprises the metal enclosure and the inner conductor disposed coaxially, and an insulation medium which is disposed between the metal enclosure and the inner conductor to insulate the metal enclosure from the inner conductor.

Step S702: electroplating the metal enclosure and the inner conductor.

Step S703: forming a non-metal layer on an outer peripheral surface of the metal enclosure of the connector through injection molding or die casting.

Step S704: pressing an insulation medium having a size matching the metal enclosure into the metal enclosure and then pressing the inner conductor into the insulation medium. The insulation medium having a size matching the metal enclosure and the inner conductor are placed into the metal enclosure sequentially. During the practical installing process, the insulation medium is firstly pressed into the metal enclosure, and then the inner conductor is pressed into the insulation medium. How the inner conductor, the metal enclosure and the insulation medium of the connector are formed and installed are all the same as those in the manufacturing process of the conventional connectors, so this will not be detailed herein.

In the conventional technology, a protective powder layer is formed on the outer peripheral surface of the connector through the powder spraying process. In contrast, in the manufacturing process of the connector provided in the present disclosure, a protective non-metal layer is formed on the outer peripheral surface of the metal enclosure of the connector through injection molding or die casting. The injection molding or die casting process is simple, requires less human intervention, and reduces the labor intensity and the production cost. Furthermore, the powders sprayed will cause pollution to the environment and injury to the operational personnel; and the thickness of the powder sprayed is difficult to control through manual operation, which reduces the "three-proofing" capabilities and the reliability of the connector. However, the protective non-metal layer formed through injection molding or die casting of the present disclosure can overcome these shortcomings; and meanwhile, the connector is partly made of a non-metal material, which can reduce the weight and the cost of the connector. The manufacturing process of the connector of the present disclosure provides a brand new manufacturing method of the connector, which can simplify the manufacturing process, improve the "three-proofing" capabilities and the reliability of the whole product and, meanwhile, reduce the labor intensity and the production cost and will not cause pollution to the environment.

Figure 10:
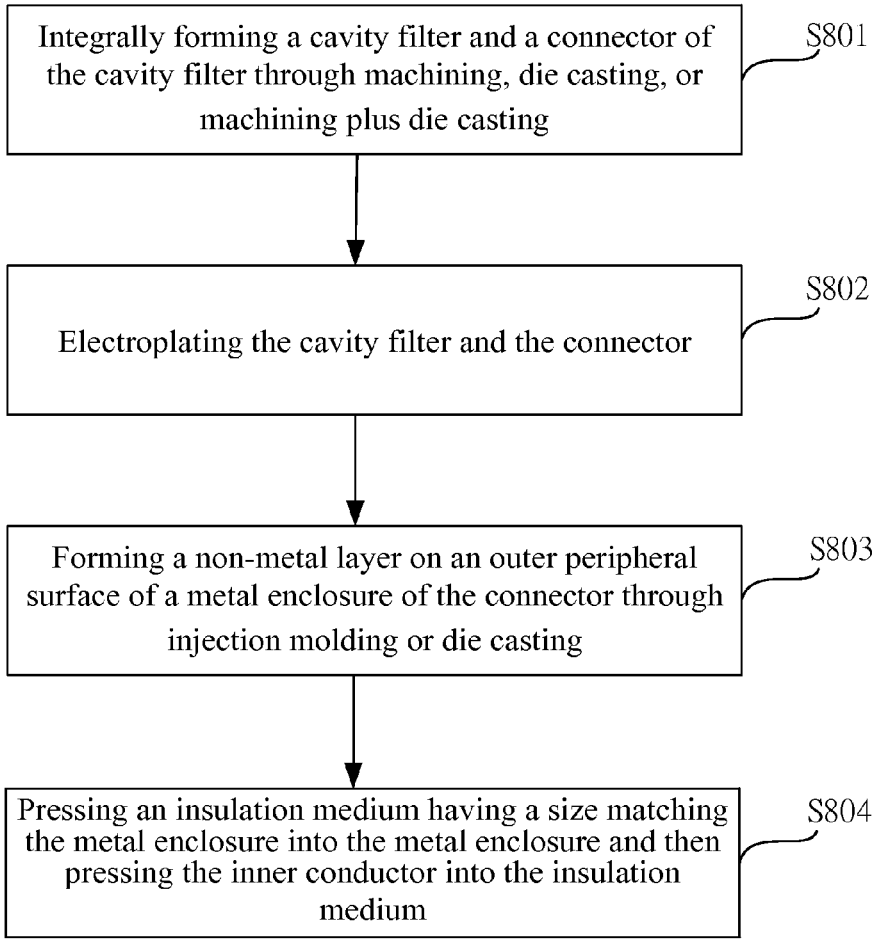
FIG. 10 is a flowchart diagram of a manufacturing process of a cavity filter according to the present disclosure.

As shown in FIG. 10, the present disclosure further provides a manufacturing process of a cavity filter, which mainly comprises the following steps of:

Step S801: integrally forming a cavity filter and a connector of the cavity filter through machining, die casting, or machining plus die casting. An end of the connector is connected with the cavity filter, and the other end thereof is connected with other communication modules. Therefore, the cavity filter and the connector may be integrally formed during the practical production process. In the prior art, this method has found wide application, so how the cavity filter and the connector are integrally formed will not be detailed herein.

Step S802: electroplating the cavity filter and the connector.

Step S803: forming a non-metal layer on an outer peripheral surface of a metal enclosure of the connector through injection molding or die casting.

Step S804: pressing an insulation medium having a size matching the metal enclosure into the metal enclosure and then pressing the inner conductor into the insulation medium. Specifically, the insulation medium may be formed through machining, and the inner conductor may be formed through machining, die casting or machining plus die casting.

In the conventional technology, a protective powder layer is formed on the outer peripheral surface of the connector through the powder spraying process. In contrast, in the manufacturing process of the cavity filter provided in the present disclosure, a protective non-metal layer is formed on the outer peripheral surface of the metal enclosure of the connector through injection molding or die casting. The injection molding or die casting process is simple, requires less human intervention, and reduces the labor intensity and the production cost, and can be streamlined with the previous processes of forming the connector and the cavity filter without human intervention. Furthermore, the powders sprayed will cause pollution to the environment and injury to the operational personnel; and the thickness of the powder sprayed is difficult to control through manual operation, which reduces the "three-proofing" capabilities and the overall performance of the cavity filter. However, the protective non-metal layer formed through injection molding or die casting of the present disclosure can overcome these shortcomings; and meanwhile the connector is partly made of a non-metal material, which can reduce the weight and the cost of the cavity filter. The manufacturing process of the connector of the present disclosure provides a brand new manufacturing method of the cavity filter, which can simplify the manufacturing process, improve the "three-proofing" capabilities and the reliability of the whole product and, meanwhile, reduce the labor intensity and the production cost and will not cause pollution to the environment.

According to the above descriptions, as compared to the conventional connectors that are made entirely of a metal material, the connector of the present disclosure is formed with a non-metal layer on the outer peripheral surface of the metal enclosure thereof, which can improve the moisture-proof capability, the salt-mist-proof capability, the mould-proof capability and the reliability of the connector and the cavity filter. Furthermore, by forming a non-metal layer through injection molding or die casting instead of forming a protection layer through the conventional powder spraying process, the resulting connector becomes more aesthetic, the production process is simple and less pollution to the environment will be caused. Also, this can simplify the manufacturing process and reduce the production costs of the cavity filter and the connector as compared to connectors formed through machining, die casting or die casting plus machining.

The principles and implementations of the present disclosure are described with reference to the specific examples herein, but the above description of the embodiments is only intended to facilitate the understanding of methods and core ideas of the present disclosure. Furthermore, those of ordinary skill in the art can make alternations to both the specific implementations and the application scope of the present disclosure according to the ideas thereof. Accordingly, the content of this specification is not to be construed as limiting the present disclosure.

What is claimed is:

1. A cavity filter, comprising a cavity, a cover plate and a connector disposed on the cavity or the cover plate, an end of the connector being connected with internal devices inside the cavity filter and the other end of the connector being connected with external communication devices, wherein the connector comprises an inner conductor and a metal enclosure disposed coaxially and an insulation medium disposed between the metal enclosure and the inner conductor, and a non-metal layer is disposed to cover an outer peripheral surface of the metal enclosure, the metal enclosure comprises a cylindrical portion and a flange portion located at an end of the cylindrical portion, and the flange portion comprises a first end surface that connects with the cylindrical portion and a second end surface that is away from the cylindrical portion, the connector is connected to the cavity filter, the flange portion of the metal enclosure is located on an outer surface of the cavity of the cavity filter, and the second end surface of the flange portion that is away from the cylindrical portion makes contact with the outer surface of the cavity of the cavity filter, the flange portion defines an annular groove surrounding the insulation medium, and a seal ring is totally disposed within the annular groove for contacting with the cavity filter, wherein the non-metal layer covers an outer peripheral surface of the cylindrical portion of the connector, the first end surface of the flange portion that connects with the cylindrical portion, an interior of the annular groove, and an area from the annular groove to an outer edge of the flange portion.

2. The cavity filter of claim 1, wherein the outer peripheral surface of the metal enclosure is provided with a restricting structure for preventing falling off of the non-metal layer, and the metal enclosure is closely joined with the non-metal layer by means of the restricting structure.

3. The cavity filter of claim 1, wherein a diameter of a cross section of the seal ring is greater than a depth of the annular groove when the connector is not installed on the cavity filter; and the seal ring is compressed and restricted inside the annular groove when the connector is installed on the cavity filter.

4. The cavity filter of claim 1, wherein the non-metal layer is formed of a plastic material or a macromolecular polymer.

* * * * *